US006251237B1

(12) United States Patent
Bos et al.

(10) Patent No.: US 6,251,237 B1
(45) Date of Patent: Jun. 26, 2001

(54) ELECTROLYTIC POT FOR PRODUCTION OF ALUMINUM USING THE HALL-HÉROULT PROCESS COMPRISING COOLING MEANS

(75) Inventors: Jerome Bos, Voreppe; Benoit Feve, Hermillon; Pierre Homsi, St. Jean-de-Maurienne, all of (FR)

(73) Assignee: Aluminium Pechiney, Paris Cedex (FR)

( * ) Notice: Subject to any disclaimer, the term of this patent is extended or adjusted under 35 U.S.C. 154(b) by 0 days.

(21) Appl. No.: 09/442,758

(22) Filed: Nov. 18, 1999

Related U.S. Application Data

(63) Continuation of application No. PCT/FR99/00802, filed on Apr. 4, 1999.

(30) Foreign Application Priority Data

Apr. 16, 1998 (FR) ..... 98 05040

(51) Int. Cl.[7] ..... C25B 15/00

(52) U.S. Cl. ..... 204/241; 204/243.1; 204/247.3; 204/247; 204/247.4; 204/247.5; 204/274

(58) Field of Search ..... 204/239, 241, 204/243.1, 247.3, 247.4, 247.5, 274

(56) References Cited

U.S. PATENT DOCUMENTS

| | | | | |
|---|---|---|---|---|
| 4,073,714 | * | 2/1978 | Roed | 204/274 |
| 4,087,345 | * | 5/1978 | Sandvik et al. | 204/274 |
| 4,287,045 | * | 9/1981 | Lechevallier | 204/274 |
| 4,436,607 | * | 3/1984 | Fischer | 204/247 |
| 4,451,337 | | 5/1984 | Frilund et al. | 204/67 |
| 4,608,134 | * | 8/1986 | Brown | 204/247 |
| 4,608,135 | * | 8/1986 | Brown | 204/247 |
| 4,749,463 | * | 6/1988 | Holmen | 204/247 |

FOREIGN PATENT DOCUMENTS

| | | |
|---|---|---|
| 2058432 | 4/1996 | (RU) . |
| 633937 | 11/1976 | (SU) . |

* cited by examiner

*Primary Examiner*—Bruce F. Bell
(74) *Attorney, Agent, or Firm*—Oblon, Spivak, McClelland, Maier & Neustadt, P.C.

(57) ABSTRACT

An electrolytic pot for the production of aluminum by the Hall-Héroult electrolysis process includes a cooling device for blowing air with localized jets, advantageously with variable flow, in order to evacuate and dissipate thermal energy from the pot. An aluminum production plant using the Hall-Héroult electrolysis process has at least some pots which, either individually or in common, include at least one cooling device.

28 Claims, 5 Drawing Sheets

ELECTROLYTIC POT FOR PRODUCTION OF ALUMINUM USING THE HALL-HÉROULT PROCESS COMPRISING COOLING MEANS

CROSS-REFERENCE TO RELATED APPLICATIONS

This application is a continuation of PCT application Ser. No. PCT/FR 99/00802 filed on Apr. 4, 1999, which designates the United States and which claims priority from French Patent application Ser. No. 98/05040 filed on Apr. 16, 1998.

BACKGROUND OF THE INVENTION

1. Field of the Invention

The invention relates to the production of aluminum by igneous electrolysis using the Hall-Héroult process and installations designed for industrial use of this process. More specifically, the invention relates to control of thermal fluxes in electrolytic pots and cooling means for obtaining this control.

2. Description of the Related Art

Metal aluminum is produced industrially by igneous electrolysis, namely electrolysis of alumina in solution in a molten cryolite bath called an electrolyte bath, using the well known Hall-Héroult process. The electrolyte bath is contained in a pot comprising a steel pot shell which is coated on the inside with refractory and/or insulating materials, and a cathodic assembly located at the bottom of the pot. The electrolysis current, which may reach values of more than 300 kA, generates alumina reduction reactions and also keeps the electrolyte bath at a temperature of the order of 950° C. by the Joule effect.

The electrolytic pot is usually controlled such that it is in thermal equilibrium. In other words, the total amount of heat dissipated by the electrolytic pot is compensated by heat produced in the pot, which is essentially derived from the electrolysis current. The thermal equilibrium point is usually chosen to give the best operating conditions, both technically and economically. In particular, the possibility of maintaining an optimum set temperature results in a significant saving in the aluminum production cost because the Faraday efficiency is kept at a very high value, exceeding 90% in the most efficient plants.

Thermal equilibrium conditions depend on the physical parameters of the pot such as the dimensions and nature of the component materials, and pot operating conditions such as the electrical resistance of the pot, the bath temperature or the intensity of the electrolysis current. The pot is frequently constructed and controlled such that a ridge of solidified bath is formed on the side walls of the pot, which in particular prevents the lining of the walls being attacked by the liquid cryolite.

The igneous electrolysis aluminum production industry is regularly confronted with the need for industrial installations that stabilize and maintain the operating point of electrolytic pots for the purposes of optimized plant management, but they must also accept deliberate changes to operating conditions which may be quite different from normal conditions. In other words, it is frequently useful to be able to control or modulate easily the operating point of plant electrolytic pots while maintaining or even improving their normal technical performances, without correspondingly increasing production costs. For example, this type of situation arises when it is required to vary the power of a series of electrolytic pots (i.e. a potline) as a function of an electricity contract.

With this objective in mind, the applicants looked for methods and means of controlling thermal fluxes and stabilizing the thermal conditions of electrolytic pots, which do not require a high investment and do not involve unacceptable additional operating costs, while providing very good efficiency and adaptability.

It has already been suggested that pots should be equipped with specific means for evacuating and dissipating heat produced in a controlled manner. In particular, the Soviet Invention Certificate Nos. SU 605,865 and SU 663,760 suggest providing pots with a cooling system controlled from the outside. Such a pot includes hermetic cavities on the sides, variable thermal shields and air conveyer means equipped with regulation valves below the pot. Air is discharged in air conveyer means through a fan or a compressor. These devices require a large and cumbersome infrastructure.

European Patent Application Serial No. 47,227 has also suggested that the thermal insulation on the pot should be increased and that the pot should be provided with heat ducts equipped with heat exchangers. Heat ducts pass through the pot shell and the thermal insulation and are plugged into carbonaceous parts such as edge slabs. This solution is fairly complex, expensive to install, and also requires major modifications to the pot.

In order to more specifically encourage the formation of a ridge of solidified bath, U.S. Pat. No. 4,087,345 also describes a pot shell equipped with stiffeners and a reinforcement frame constructed to encourage cooling of the pot sides by natural convection of ambient air. This type of device requires installations fixed to the pot shell. Furthermore, static devices are not very suitable for precise control of thermal fluxes.

In order to control the formation of the ridge of solidified bath and to recover part of the heat drawn out from the sides of the pot, U.S. Pat. No. 4,608,135 proposes using a pot in which passages are laid out between the edge slabs and the inside insulation of the pot shell, and air inlet orifices on the sides of the pot. Passages communicate firstly with the orifices and secondly with the inside of the collection device fixed on the pot. The collection device draws in ambient air taken from the sides of the pot through the orifices and entrains its flow through the passages along the edge slabs. This device has the effect of cooling them. The air flow is controlled by dampers fitted with valves located on the sides of the collection device, which valves act as bypass pipes. This device requires major modifications to the pot and does not enable independent control of cooling, since regular work on the pot makes it necessary to open the collection device covers and to disturb the effect of the dampers.

After observing that there are no satisfactory known solutions, the applicants set the objective of finding efficient and adaptable means of evacuating and dissipating heat produced by the electrolytic pot, so that the pot can easily be set up and which does not require any major modifications to the pot, particularly to the pot shell, or to any major infrastructure. In order to enable use in existing plants and in new plants in particular, the applicants searched for means of modifying the power of the pots, which modifiers can be easily adapted to different types of pots or to different operating modes of the same type of pot, and which are suitable for industrial installations comprising a large number of pots in series.

SUMMARY OF THE INVENTION

The first object of the invention is an electrolytic pot for production of aluminum by the Hall-Héroult electrolysis process which includes cooling means for blowing air with localized and distributed jets.

The second object of the invention is an aluminum production plant using the Hall-Héroult electrolysis process, characterized in that the plant comprises pots according to the invention.

The electrolytic pot for production of aluminum using the Hall-Héroult electrolysis process according to the invention comprises a steel pot shell, internal lining elements and a cathodic assembly. The pot is characterized in that it comprises cooling means for blowing air with localized jets distributed around the pot shell.

Thus, according to the invention, air is blown by the localized jets. In other words, a circuit is opened and an air stream is not recovered. The air stream blown onto the surface is then diluted in ambient air, such that it is not essential to add specific means for cooling the blown air, which is heated as it comes into contact with the walls.

Air blown in the form of localized jets, in other words, air blown in the form of directional and confined streams, is thus blown on a relatively small area of the pot shell, in order to efficiently cool the pot wall at specific locations. The jets are distributed around the pot shell in order to fix preferred cooling areas on the surface of the pot shell. These areas are advantageously determined as a function of the heat profile of the pot, particularly in order to increase the global cooling efficiency.

More precisely, the cooling means are characterized in that they comprise air blower means to cool the pot shell, in other words, to evacuate and dissipate heat produced by the pot in the pot shell. The blower means form localized jets, and they include means for distributing the jets around the pot shell according to a given distribution.

The invention can thus control or modulate the power of the electrolytic pots by the addition of efficient and adaptable cooling means which may have fixed or variable extra cooling power over and above the normal power. The invention thus makes it possible to modify the power of each pot individually.

The air flow from the blower means according to the invention may be variable to enable finer control of cooling, or possibly regulation of cooling. It is also advantageous to be able to integrate means according to the invention into regulation systems used on the most modern electrolytic pots. Cooling means can then be checked or even controlled by the pot regulation system, such that the thermal flux may be regulated more efficiently, possibly in an automated manner.

The pot may include additional cooling means such as static cooling means. Cooling means may be removable, in the sense that they can be easily put into position or taken out of the pot, in some cases even while it is in operation. Thus, for example, when a pot is being tended, cooling means may be completely or partly removed. Such removal facilitates access to the pot shell and the maintenance work.

In some applications, it may be advantageous to assemble cooling means according to the invention in the form of a completely or partly automatic cooling device. This type of assembly can then be used in a global design and can very much facilitate operation. The general air flow of the device may be variable.

According to the preferred embodiment of the invention, the cooling means include air distribution means to distribute the air flow around the pot shell, an air propulsion apparatus which pulses or discharges air into the air distribution means, and localized blower means in order to locally blow air in the form of jets, said localized blower means being placed at specific locations on the pot shell. The distribution means preferably include air conveyer means, such as ducts. The localized blower means may be regulating nozzles, ejectors, blast pipes, jet nozzles or pipes. Localized blower means are advantageously distributed along the air conveyer means. The air flow from the propulsion means may be variable. The air flow due to one or several localized blower means may also be individually variable.

The aluminum production plant based on the Hall-Héroult electrolysis process according to the second object of the invention is characterized in that the plant comprises pots according to the first object of the invention. The pots may be individually equipped with cooling means according to the invention.

The pots may be individually equipped with the cooling device according to the invention, which may possibly be controlled in a centralized manner.

In general in electrolysis plants, electrolytic pots are grouped or laid out in series. In these cases, the pots may advantageously be equipped with cooling means according to the invention, which may be completely or partly common to two or several pots. In other words, two or several pots have one of the cooling means in common. In particular, in some cases, it is advantageous to arrange the design such that one cooling means is common to two or more pots.

DETAILED DESCRIPTION OF THE INVENTION

Figure 1:
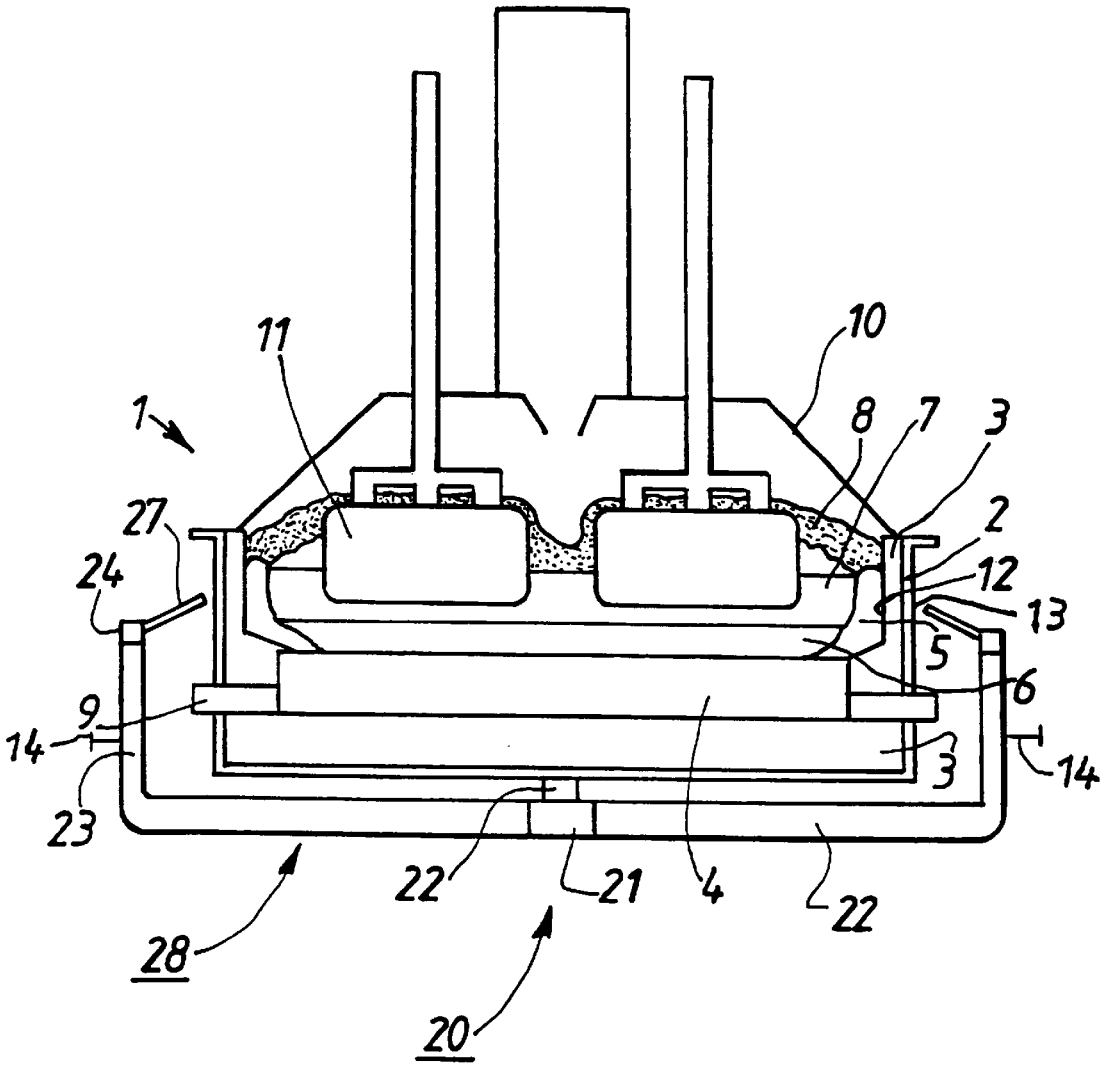
FIG. 1 is a cross-section that diagrammatically illustrates an electrolytic pot comprising cooling means, assembled in the form of a cooling device, according to a preferred embodiment of the invention.

As shown in FIG. 1, an electrolytic pot 1 for the production of aluminum by the Hall-Héroult electrolysis process according to the invention comprises a steel pot shell 2, inside lining elements 3, a cathodic assembly 4, and at least one cooling device 20 for blowing air with localized jets distributed around the pot shell 2. A plurality of valves 14 vary the air flow from the cooling device 20.

The inside lining elements 3 are usually made of blocks of refractory materials which may be thermal insulators. The cathodic assembly 4 comprises connection bars 9 fixed to electrical conductors used to carry the electrolysis current. Lining elements 3 and the cathodic assembly 4 form a crucible inside the pot 1, said crucible being used to contain an electrolyte bath 7 and a layer of liquid aluminum metal 6 when the pot 1 is loaded. Anodes 11 are partially immersed in the electrolyte bath 7. The electrolyte bath 7 contains dissolved alumina and usually an alumina cover 8 covers the electrolyte bath 7.

The liquid aluminum metal 6 produced during the electrolysis accumulates at the bottom of the pot 1, such that it forms a fairly well defined interface between the liquid metal 6 and the molten electrolyte bath 7. The position of this bath-metal interface varies with time; e.g., it rises as the liquid metal 6 accumulates at the bottom of the pot 1 and it drops when the liquid metal 6 is extracted from the pot 1.

Electrolytic pots 1 are usually controlled by controlling several parameters such as the alumina concentration of the electrolyte, the temperature of the electrolyte bath 7, and the total height of the bath or the position of the anodes 11. In general, an attempt is made to form a bath ridge 5 of solidified cryolite on internal side walls 12 of the crucible that are in contact with the electrolyte bath 7 and with the liquid metal 6. The side walls 12 are frequently composed of edge slabs made of carbonaceous materials or based on carbonaceous compounds, such as a SiC-based refractory material, and of a fireproof lining paste. In order to increase the efficiency of the cooling device 20 according to the invention, the internal side walls 12 of the crucible may comprise preformed blocks or sides, preferably homogenous, composed of a material with a high thermal conductivity, in all cases greater than the conductivity of the fireproof lining paste, and also preferably at least equal to the conductivity of the edge slabs normally used, for example, such as a SiC-based material.

Preferably, the pot 1 is also provided with a collection device for collecting and recovering gaseous effluents emitted by the electrolyte bath 7 during electrolysis. The collection device includes a hooding 10 over the entire pot 1 which is usually fitted with access openings.

Figure 2:
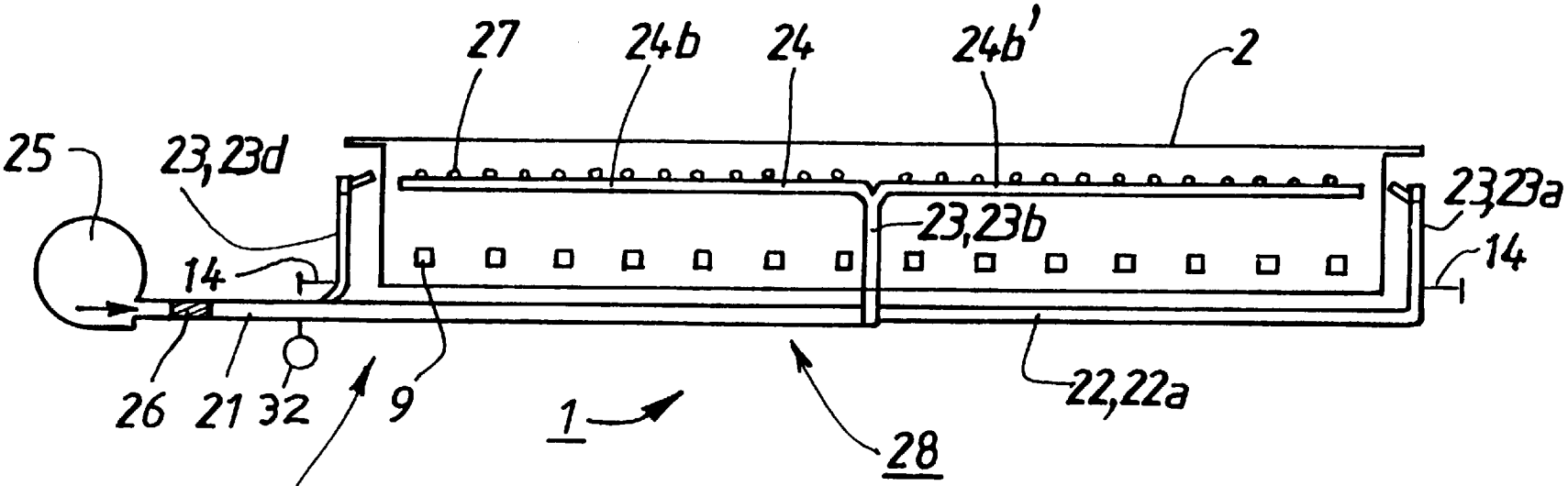
FIG. 2 is a side view that diagrammatically shows an electrolytic pot according to the embodiment of the invention in FIG. 1.

According to one preferred embodiment of the invention shown in FIG. 2, cooling device 20 includes air conveyers 28 such as ducts 21–24, a propulsion apparatus 25 for blowing air in the air conveyers 28, and localized blowers 27 for spraying air in the form of localized jets.

The air conveyers 28 may be held in position by different means. In particular, they may be fixed to elements of the pot structure by reinforcement, such as stiffeners, which may be modified or adapted for this purpose. The air conveyers 28 may also be placed in contact with or adjacent to the pot shell 2, or they may be fixed to the pot shell deck plate.

The main air flow in the cooling device 20 may advantageously be variable, for example by using valves 14 or by varying the flow from the propulsion apparatus 25. The air flow from one or several localized blowers 27 may also be variable by different mechanisms, possibly individually, and also with the possibility of reducing the air flow of selected blowers 27 to zero. In some cases, the air flow may be pulsated. In other cases, the air flow may be varied by a device 32, such as a switch or a dial, that regulates the voltage supplied to at least one of the blowers 27.

The cooling device 20 according to the invention may be completely or partly removable. In particular, the ducts 21–24 may be easily removable and transportable, particularly due to a design consisting of segments and appropriate assembly means. Air pulsed in air conveyers 28 is blown on external side walls 13 of the pot shell 2 at predetermined locations, using localized blowers 27 that are advantageously distributed along the air conveyers 28. The localized blowers 27 are not necessarily distributed uniformly on the surface of the pot shell 2; it may sometimes be preferable to concentrate them in some specific areas.

The localized blowers 27 are used to direct the air flow at precise locations on the pot shell 2, for example at the height of the electrolyte bath 7. It is advantageous that one or several localized blowers 27 can be of adjustable direction. The localized blowers 27 spray blown air at a speed called the ejection speed, which is preferably between 10 and 100 meters per second (m/s), and also preferably between 20 and 70 m/s.

The number, position and dimensions of localized blowers 27, the power of the propulsion apparatus 25 and the configuration and dimensions of the ducts 21–24 are chosen such that the air flow is sufficient to enable efficient cooling and to provide a determined cooling power at the selected blowing points, taking special care with the aerodynamics of the network.

The air propulsion apparatus 25 may be a fan that blows out ambient air, or a compressed air blower such as a fan-blast pipe, or an expanded compressed air system, or a high pressure air network.

For electrical safety reasons, it is sometimes preferable to isolate electrically the air propulsion apparatus 25 from the rest of the cooling device 20 using electrical insulation 26 such as a section of a pipe made of an electrically insulating material.

The ducts 21–24 may be composed of metallic materials, preferably nonmagnetic (such as nonmagnetic stainless steel or aluminum), or insulating materials (such as glass fiber) or a combination of them (such as a metal duct fitted with an insulating casing).

The cooling device 20 may possibly be controlled by the pot main regulation system, in order to provide a more efficient centralized global regulation.

The pot 1 may also be provided with complementary cooling means, particularly static cooling means such as ribs or equivalent means. In order to increase the global efficiency of the complimentary cooling means or the cooling device 20, it is advantageous in some cases and/or at some locations of the pot 1 to combine the effect of the localized blowers 27 with the effect of the complementary means.

According to one variant of the invention, for example as illustrated in FIG. 2, the air conveyers 28 form branches, in other words, they are made up such that a main pipe 21 separates into horizontal duct branches 22*a* under the pot shell 2, vertical duct branches 23*a–d* at the sides and ends of the pot shell 2 and horizontal duct branches 24*b*, 24*b*' at the sides and ends of the pot shell 2. This configuration provides satisfactory aeronautic balancing of the duct network and facilitates installation of the cooling device 20. In particular, vertical branches may be placed between cathodic connection bars 9.

Figure 4:
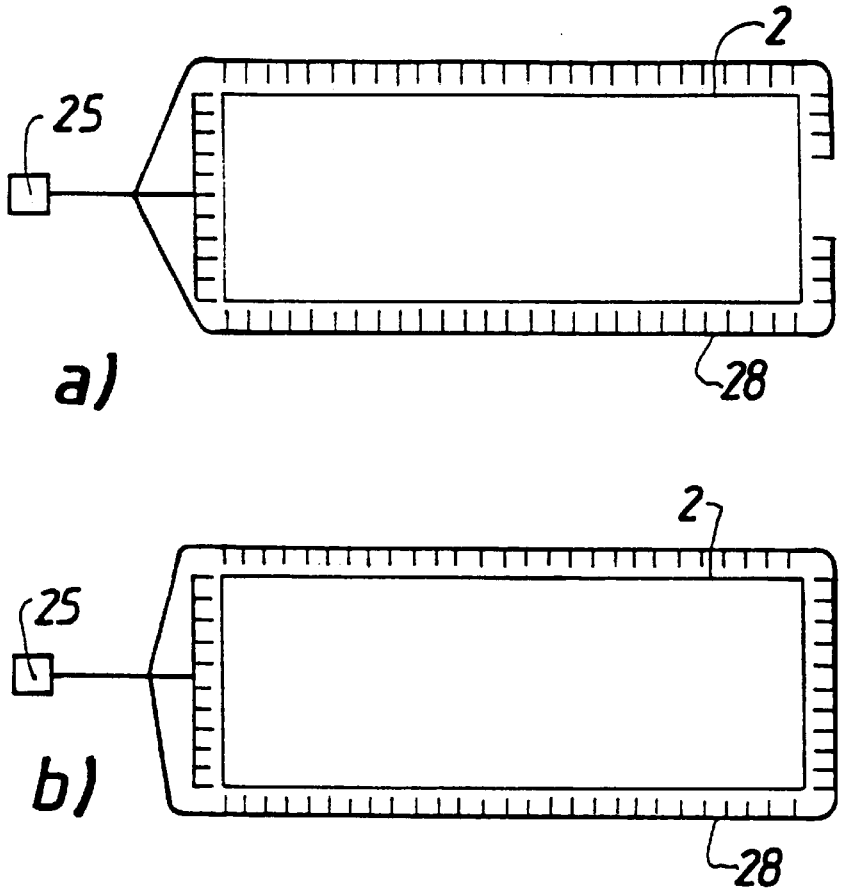
FIGS. 4(*a*) and (*b*) illustrate nonrestrictive variants of the invention in which the air conveyer means completely (b) or partly (a) surrounds the electrolytic pot.

According to another variant of the invention, for example as illustrated in FIG. 4, air conveyers 28 surround or embrace all or part of the pot shell 2 of the electrolytic pot.

Figure 5:
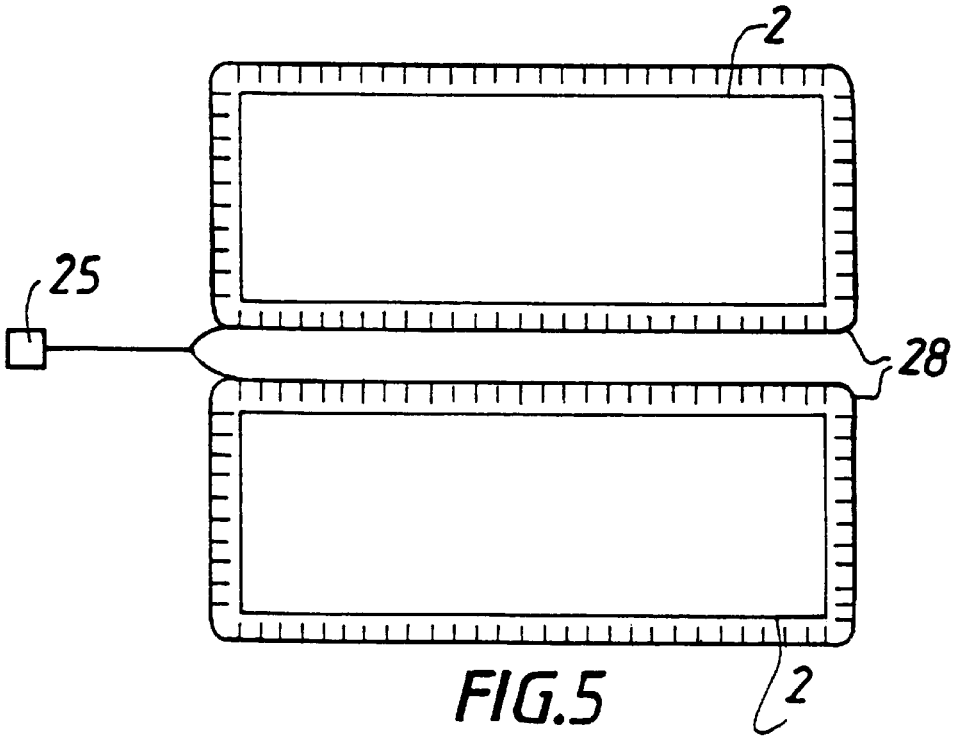
FIGS. 5 and 6 illustrate nonrestrictive variants of the invention in which the same propulsion means is common to more than one pot.
Figure 6:
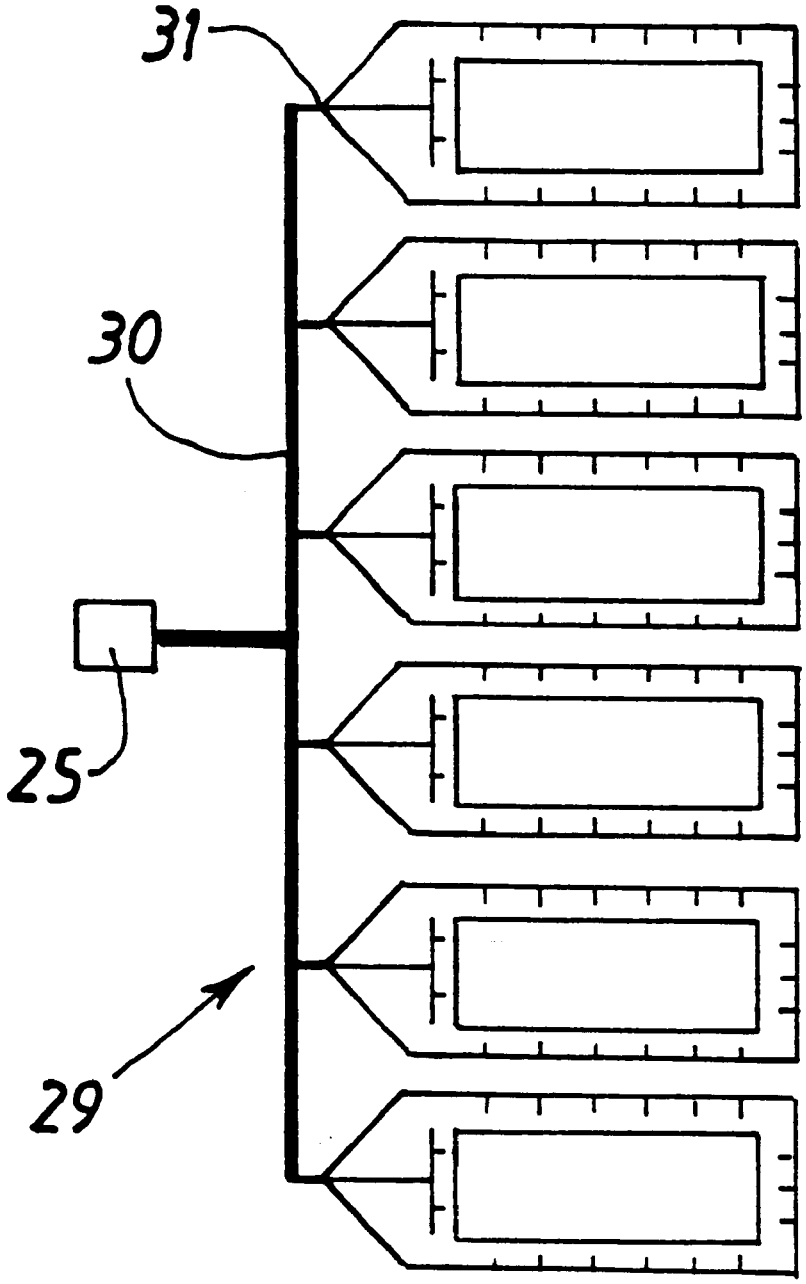

According to the variants of the invention illustrated in FIGS. 5 and 6, a single air propulsion apparatus 25 is common to more than one pot, and more precisely to two pots or more pots in a plant. The air propulsion apparatus 25 distributes the air flow through a network 29 in FIG. 6 comprising a common main duct 30 and a connection point 31 for each pot. Connection points 31 may be provided with valves to isolate each pot individually and to vent and rebalance the distribution of air flows. Valves and vents are particularly useful when doing work on a particular pot or on some pots, since they can isolate the pot or pots concerned while maintaining satisfactory air flows for the other pots connected to the network 29.

In a plant, cooling means are advantageously instrumented or controlled using a regulation system common to more than one pot. Typically, each pot equipped with its own cooling means or each group of pots equipped with cooling means with elements in common (particularly the propulsion means) may be controlled by a regulation system called a "first level" system, and all pots or groups of pots in a particular electrolysis hall in the plant may also be controlled globally by a "second level" regulation system.

EXAMPLE

Tests were carried out on 300 kA electrolytic pots with a cooling device conforming to the invention, with the following specific characteristics.

Figure 3:
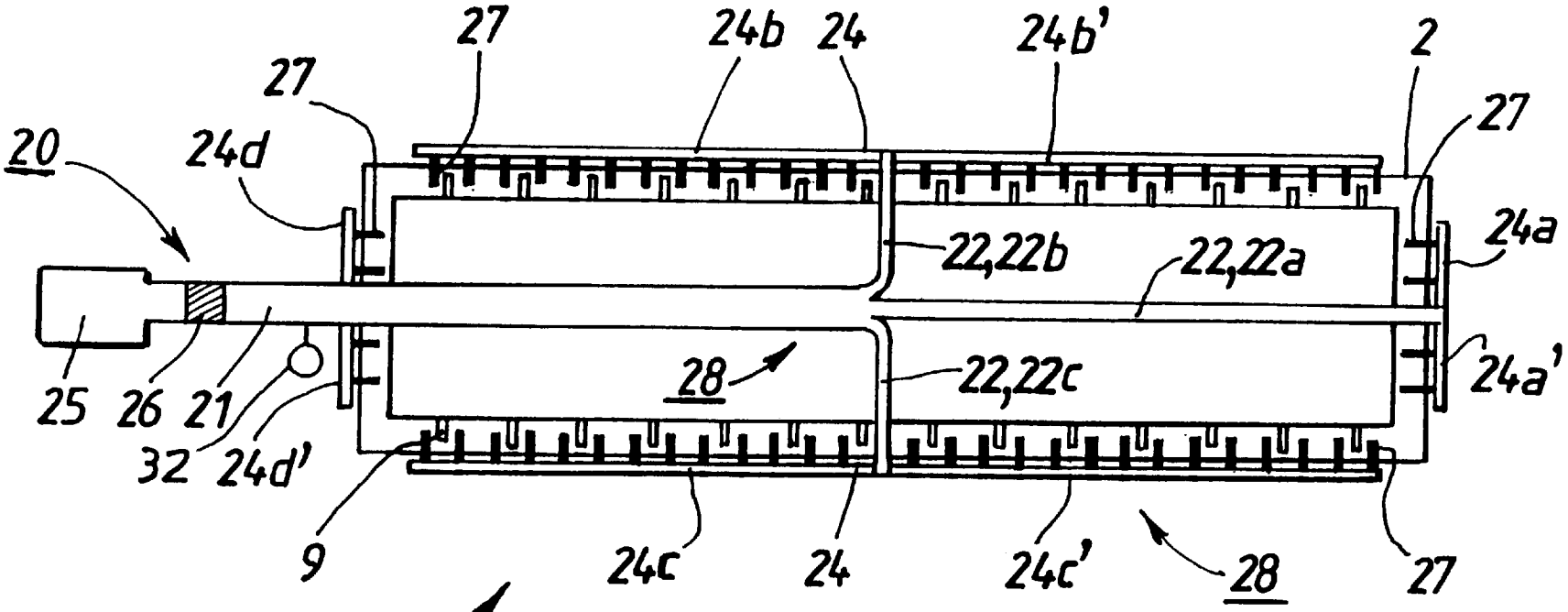
FIG. 3 is a bottom view that diagrammatically shows an electrolytic pot according to the embodiment of the invention in FIG. 1.

With reference to FIGS. 2 and 3, the main duct 21 passes longitudinally under the pot shell 2 until almost the center of the pot 1, and then divides into three branches 22*a*, 22*b*, 22*c* perpendicular to each other and with a smaller cross-section than the main duct 21. The horizontal branch 22*a* extends under the pot shell 2 to its other end and then forms the vertical branch 23*a* that rises along the head of the pot 1 approximately to the same height as the edge slab, and then splits into two horizontal branches 24*a*, 24*a*' which extend to the sides of the pot 1. The other two transverse branches 22*b*, 22*c* extend as far as the sides of the pot shell 2 and then form vertical branches 23*b*, 23*d* which rise along each side of the pot shell 2 approximately as far as the pot edge slab, and then split into horizontal branches 24*b*, 24*b*', 24*c*, 24*c*' which extend on each side of the pot 1, and then extend as far as the ends of the pot 1. The vertical branch 23*d*, equivalent to the branch 23*a*, is directly connected to the main duct 21 and also splits into two horizontal branches 24*c*, 24*c*'.

Nozzles 27 were placed uniformly along the branches. According to the tests, the number of nozzles 27 was five to eight along each end of the pot 1 and 15 to 20 nozzles 27 along each side of the pot 1. The nozzles 27 were directed approximately towards the theoretical metal bath level in most tests. In some tests, some nozzles 27 were directed towards structural reinforcing elements of the pot shell 2, which thus act as cooling ribs. The ducts 21–24 and nozzles 27 were made of steel, and partly of stainless steel.

The air propulsion apparatus 25 was a mechanical fan in some tests, and a fan-blast pipe in other tests. Cooling devices 20 were provided with mechanisms to vary the air flow, such as valves 14 or voltage regulators 32.

Tests showed that the cooling device 20 remained efficient for air outlet speeds at the nozzle output of between 10 m/s and about 100 m/s. The efficiency of the cooling device 20 dropped considerably until it became practically ineffective for speeds of less than 10 m/s. Speeds of more than 100 m/s led to very high head losses, which would have resulted in air propulsion apparatuses 25 with unacceptable powers and/or costs. The best results were obtained with outlet speeds of between 20 and 70 m/s.

Temperature measurements made using thermocouples and pyrometers demonstrated that the cooling device 20 was capable of producing average temperatures drops of 50 to 100° C. at the external side walls 13. The regulation of the cooling device 20 was easily obtained by varying the pulsed air flow.

Surprisingly, the applicants thus found that it was possible to achieve satisfactory cooling rates by blowing air according to the invention, without the need for propulsion and blower means or excessive or disproportionate ducts, and/or ducts which would require excessive or unacceptable investments and/or operating costs.

These tests also showed that air blown onto the external side walls 13, and which is heated on contact with the pot 1, dilutes fairly quickly in the ambient air and does significantly increase the temperature of the ambient air. In other words, tests did not show values of ambient temperature that are significantly different from values normally observed near to pots 1 according to the prior art, even when the ambient temperature reaches extreme values in summer. It was also observed that the noise produced by the cooling device 20 was surprisingly low.

The cooling device 20 according to the invention is capable of evacuating and dissipating thermal energy produced in the electrolytic pot 1 by optimal control of some thermal fluxes, which may be adapted to weather conditions and/or pot operating conditions that can be significantly different from normal or standard conditions. Cooling device 20 can also accurately control the formation of the bath ridge 5 within the electrolytic bath 7.

The cooling device 20 according to the invention is easily adapted to any type of pot 1 and to different environments. A plurality of the cooling devices 20 can easily be put into place on existing pots 1, particularly during renovation of the pots 1, when adding temperature regulation and/or changing the normal intensity. More specifically, the invention facilitates variations in the power of pots 1, for example, to take account of technical, economic and/or contractual constraints. In particular, the invention can increase the normal intensity of existing pots 1 without causing premature degradation of the pots 1.

In an electrolysis plant according to the invention, control of several pots 1 or even a complete series of pots 1, and operating conditions, can be optimized at the same time by adapting the cooling device 20 for each individual pot 1, in particular to make the pot operating point the same. In particular, the invention enables individual temperature control of the pots 1 in a plant, which is often necessary in high productivity plants. For example, this is the case during transient phases that often occur when several pots 1 in the same series have new linings, or if they are different from the rest of the series.

The invention can also be used for the modernization of existing plants without the need for infrastructure work which would make this type of operation unacceptable. The invention can also extend the life of a pot 1 near the end of its life, if there are any abnormal hot spots on the pot shell 2.

Clearly, numerous modifications and variations of the present invention are possible in light of the above teachings. Thus, it is to be understood that, within the scope of the appended claims, the invention may be practiced otherwise than as specifically described herein.

What is claimed is:

1. Electrolytic pot for production of aluminum by the Hall-Héroult electrolysis process comprising:

a shell, internal lining elements in said shell, a cathodic assembly also in said shell, and at least one cooling device including an air distributor, an air propulsion apparatus positioned to pulse air into the air distributor, and localized air blowers distributed around the shell.

2. Pot according to claim 1, further comprising a mechanism that varies air flow from the cooling device.

3. Pot according to claim 2, wherein the mechanism includes at least one valve that varies air flow from the air propulsion apparatus.

4. Pot according to claim 2, wherein the mechanism is a device that regulates voltage supplied to the air blowers so that air flow therefrom is varied.

5. Pot according to claim 1, further comprising a regulation system that controls the cooling device.

6. Pot according to claim 1, wherein the cooling device is segmented so as to be at least partly removable.

7. Pot according to claim 1, wherein the cooling device is assembled adjacent to external side walls of the shell.

8. Pot according to claim 1, wherein the localized air blowers include a plurality of localized jets.

9. Pot according to claim 1, further comprising a valve that varies air flow from at least one of the localized air blowers.

10. Pot according to claim 1, wherein at least one of the localized air blowers is adjustable in direction.

11. Pot according to claim 1, wherein the localized air blowers are chosen from the group consisting of regulating nozzles, ejectors, blast pipes, jet nozzles and pipes.

12. Pot according to claim 1, wherein the localized blowers spray blown air at a speed of between 10 and 100 meters per second.

13. Pot according to claim 12, wherein the localized blowers spray blown air at a speed between 20 and 70 meters per second.

14. Pot according to claim 1, wherein the air propulsion apparatus is chosen from the group consisting of fans, compressed air blowers, expanded compressed air systems and high pressure air networks.

15. Pot according to claim 1, wherein the air distributor comprises air conveyers.

16. Pot according to claim 15, wherein the air conveyers are ducts.

17. Pot according to claim 15, wherein the localized blowers are distributed along the air conveyers.

18. Pot according to claim 15, wherein the air conveyers form branches.

19. Pot according to claim 15, wherein the air conveyers surround the shell at least in part.

20. Pot according to claim 1, wherein a crucible is formed inside the shell by the lining elements and the cathodic assembly, said crucible having internal side walls composed of preformed blocks.

21. Aluminum production plant using the Hall-Héroult electrolysis process, wherein the plant comprises:

a plurality of electrolytic pots, each pot having a shell, internal lining elements in said shell, and a cathodic assembly also in said shell, and at least one cooling device that blows air around at least one of the plurality of electrolytic pots, said cooling device including an air distributor, an air propulsion apparatus positioned to pulse air into the air distributor, and localized air blowers distributed around each shell.

22. Plant according to claim 21, wherein at least two pots share at least one cooling device in common.

23. Plant according to claim 21, wherein at least two pots share the air propulsion apparatus in common.

24. Plant according to claim 23, wherein the common air propulsion apparatus is a network having a common main duct and a connection point for each of the plurality of pots to distribute the air flow.

25. Plant according to claim 24, wherein each connection point includes at least one valve to isolate an associated pot at the connection point and with at least one vent to rebalance a distribution of air flows.

26. Plant according to claim 21, further comprising a regulation system that controls the cooling device common to at least two pots.

27. Plant according to claim 21, further comprising valves that vary air flow from the cooling device.

28. Plant according to claim 21, further comprising a device that regulates voltage supplied to the air blowers so that air flow therefrom is varied.

* * * * *

UNITED STATES PATENT AND TRADEMARK OFFICE

CERTIFICATE OF CORRECTION

PATENT NO. : 6,251,237 B1
DATED : June 26, 2001
INVENTOR(S) : Bos et al.

It is certified that error appears in the above-identified patent and that said Letters Patent is hereby corrected as shown below:

Title page,
Item [63], the Related U.S. Application Data should read:

-- Related U.S. Application Data

[63] Continuation of application No. PCT/FR99/00802, filed on Apr. 7, 1999. -- ;

Column 1,
The first paragraph should read:

-- CROSS-REFERENCE TO RELATED APPLICATIONS

This application is a continuation of PCT Application Ser. NO. PCT/FR99/00802, filed on Apr. 7, 1999, which designates the United States and which claims priority from French Patent application Ser. No. 98/05040 filed on Apr. 16, 1998. --

Signed and Sealed this

Nineteenth Day of February, 2002

*Attest:*

*Attesting Officer*

JAMES E. ROGAN
*Director of the United States Patent and Trademark Office*